US005328165A

United States Patent [19]

Martin

[11] Patent Number: 5,328,165

[45] Date of Patent: Jul. 12, 1994

[54] DEVICE FOR THE TAKE-UP OF PLANE SHEETS WITH PEEL-OFF BY TURBULENT AIR FLOW

[76] Inventor: Guy Martin, Rue des Alisiers 4, Flémalle, Belgium, 4400

[21] Appl. No.: 768,400

[22] PCT Filed: Mar. 17, 1989

[86] PCT No.: PCT/BE89/00012

§ 371 Date: Oct. 16, 1991

§ 102(e) Date: Oct. 16, 1991

[87] PCT Pub. No.: WO90/11240

PCT Pub. Date: Oct. 4, 1990

[51] Int. Cl.[5] ..... B65H 3/14

[52] U.S. Cl. ..... 271/98

[58] Field of Search ..... 271/98, 97

[56] References Cited

U.S. PATENT DOCUMENTS 4,699,369 10/1987 Zirilli ..... 271/94
4,887,805 12/1989 Herbert et al. ..... 271/98 X
5,181,706 1/1993 Yamamoto et al. ..... 271/98 X

FOREIGN PATENT DOCUMENTS 0110649 6/1984 European Pat. Off. .
0273898 7/1988 European Pat. Off. .
2099099 3/1972 France .
10288538 11/1989 Japan ..... 271/98
2164926 4/1986 United Kingdom .

*Primary Examiner*—David H. Bollinger
*Attorney, Agent, or Firm*—Pennie & Edmonds

[57] ABSTRACT

In conjunction with an apparatus for seizing flat sheets on a stack of sheets arranged on a supply table (1), a sheet-separating device (10) is characterized by an air flow generator (15) and guide (A,B) designed to direct a turbulent air flow produced by the generator (15) on at least one side of the stack of sheets. The guide comprises a first tube (A) arranged so as to direct a flow of air produced by the generator (15) onto one side of the upper part of the stack of sheets (100) placed on the supply table (1) and a second tube (B) for directing an air flow produced by the generator (15) in the upper part of the free space (8) located under the sheet-seizing device (2).

10 Claims, 7 Drawing Sheets

DEVICE FOR THE TAKE-UP OF PLANE SHEETS WITH PEEL-OFF BY TURBULENT AIR FLOW

DESCRIPTION

1. Field of the invention

The present invention relates to a device for the automatic and uniform take-up of plane sheets, for example sheets of paper, from a sheet stack feeding a machine in which plane sheets move along one by one, for example an assembler.

2. Prior art

There are various types of sheet take-up devices capable of delivering the sheets at a predetermined rate. In suction devices, the sheets are in contact with suckers and they are transported as a result of the mechanical displacement of the suckers. The rubber of the suckers dries out and is the cause of more or less frequent replacements. Moreover, these devices require exact adjustment of the suction. An anomaly (for example a double sheet) is detected only when the sheets have executed a certain amount of movement, and this often gives rise to jamming, rejects and the intervention of the operator.

Friction devices employ a constant pressure maintained on the sheet by means of pads or rollers. It is difficult to adjust the pressure, and this makes it possible to process only a somewhat limited range of sheets and does not allow the processing of very thin sheets, for example delicate papers.

Suction and friction devices are not insensitive to variations in the parameters which characterize the sheets to be extracted from a stack: physical dimensions, weight and overall size of the sheets, their humidity, their mutual adhesion, and static electricity, moreover these parameters being variable at random within the same stack of sheets of the same type. With particular regard to paper sheets, it should be noted that the consumption of paper is tending towards a steady increase in the use of delicate papers, for example self-copying papers. The friction machines known at the present time do not satisfy the working conditions in this sector, and suction machines satisfy them only with difficulty.

Also known is a device for the take-up of sheets by suction through a movable grid, which is of simple and compact construction and which is capable of operating reliably and at a high rate with sheets of different thicknesses, types and dimensions, thus considerably reducing rejects and interventions by the operator.

To ensure a uniform rapid flow of the sheets, it is essential that the sheets be extracted and delivered one by one in a reliable manner. Now it can happen that two or more sheets adhere to one another or that the upper sheet of a sheet stack does not succeed in being extracted from the stack.

A stack of sheets, for example of paper, is defined by various parameters, such as the dimensions and weight of the sheets, static electricity, humidity and mutual adhesion attributable to the freshness of the printing ink. These parameters are variable at random within the same stack of paper of the same type. This causes problems regarding the separation of the sheets in the assembling machines, thus necessitating preprocessing before passing to the machine.

PRESENTATION OF THE INVENTION

The present invention affords a solution to this problem and relates to a device for effectively peeling off a sheet stack installed in the feed compartment of a machine, so as to ensure the delivery of the sheets one by one, even when sheets adhere to one another or when the upper sheet does not succeed in being extracted from the sheet stack. The particular features of the invention are defined in the accompanying claims.

DESCRIPTION OF THE DRAWINGS

The invention is presented below by means of the accompanying drawings. In these drawings.

DESCRIPTION OF AN EXEMPLARY EMBODIMENT

Figure 1:
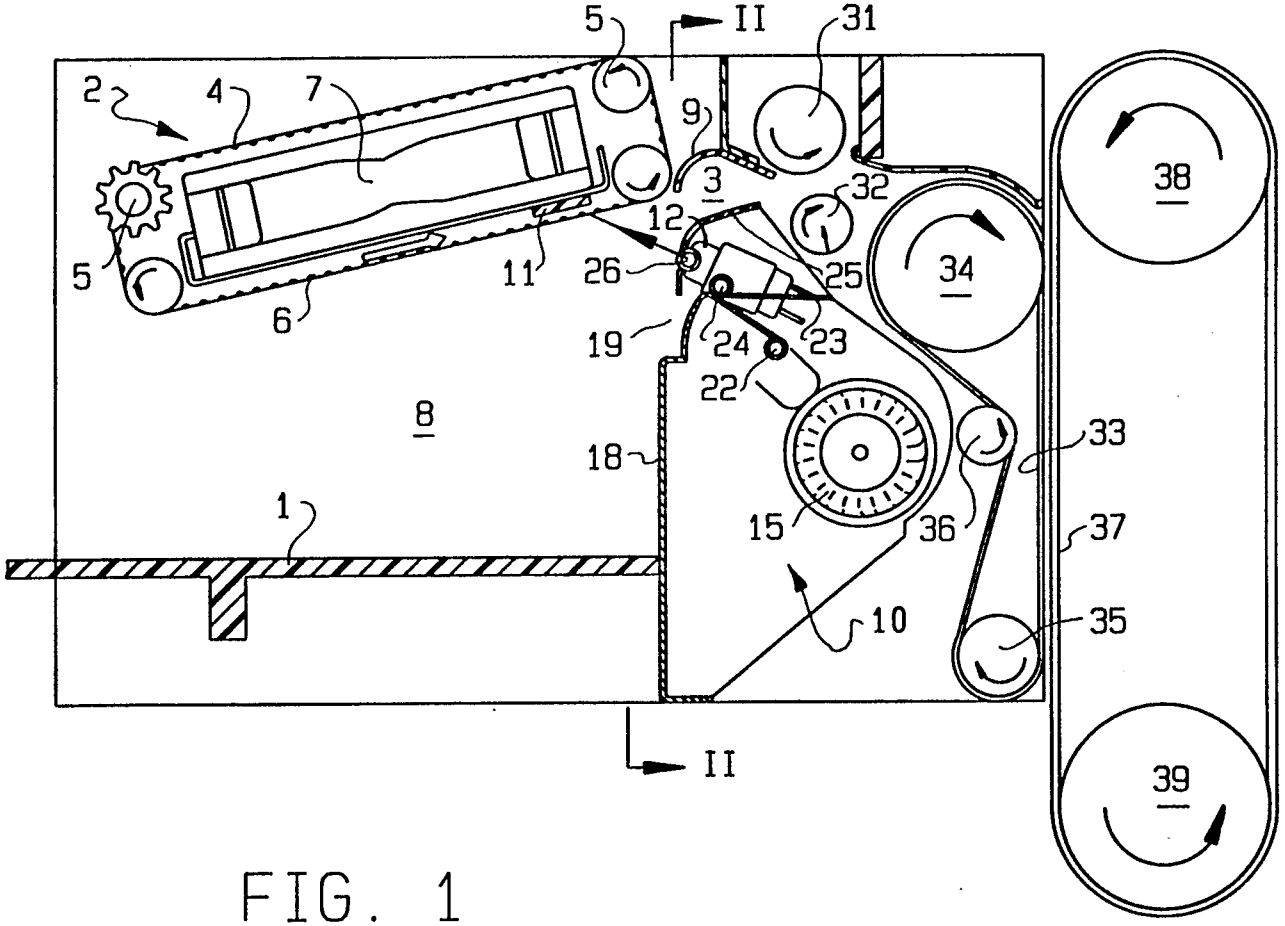
FIG. 1 is a partially sectional elevation view of an exemplary embodiment of the invention.

Referring to FIG. 1, this shows a feed compartment of an exemplary assembling machine. Mounted above a feed table 1 is a sheet take-up device 2. The sheet take-up device illustrated by way of example comprises a perforated grid 4 mounted on a stand of the assembly as a whole, in such a way as to be capable of being displaced in translational movement under the action of a drive mechanism comprising particularly the gear-wheels and rollers 5. In the embodiment illustrated, the grid 4 is closed on itself and it comprises a portion 6 which can move above the table 1 in the direction of the ejection area 3. Mounted above the grid portion 6 is a suction means consisting, for example, of fans 7. A deflector 9 mounted above the ejection area 3 and extending over the entire transverse width of the device advantageously closes off the top of the ejection area.

With a stack of plane sheets being deposited on the feed table 1 and the suction fans 7 being put into operation, the latter generate a draft of air in the free space 8, the air flows sucked up entering said space via the open lateral sides of the device. Under the action of these lateral air flows, the upper sheets of the stack are set in vibration, and the top sheet bends, comes into contact with the grid 6 and is kept adhering to this by suction through the grid. This sheet is then carried along by the grid 6 when the latter is set in motion, and it is guided towards the ejection area 3, whilst the following sheet is being sucked up against the grid. The sheets are thus sucked up one by one and conveyed in succession towards the ejection area.

The relative distance between the lower plane 6 of the grid and the top of the sheet stack on the feed table is kept constant in proportion as the height of the sheet stack decreases. The feed table 1 is mounted, for example, on a mechanism intended for displacing it vertically in proportion to the decrease in height of the sheet stack, in order to keep the top of the stack at a constant distance from the grid portion 6. Conversely, the sheet take-up device could be mounted so as itself to be displaced in relation to the feed table 1 which would be stationary.

The simplicity and compactness of the above-described sheet take-up device which has neither suckers nor rollers nor pads, make it possible to produce it as an especially advantageous and reliable element or module for integrated machines of modular construction.

The control of all the members can be integrated in a programming system for the general automatic control of the device under the supervision of detection elements controlled by a processor which can be incorporated in the machine. Detection elements are provided for controlling the operation of the sheet take-up device. In particular, a detection element serves for detecting the presence or absence of sheets on the feed table 1. A plurality of detection elements can be arranged at predetermined spacings so as to be capable of detecting the format of the sheets stacked on the feed table 1 and of commanding the activation of the desired number of fans 7, and a detection element serves for monitoring the passage of the sheets through the ejection area 3.

To ensure a uniform rapid flow of sheets, it is essential that the sheets be extracted from the feed table and delivered one by one. This result is achieved, by virtue of the invention, by a peel-off device arranged so as to act effectively in circumstances where an operating anomaly occurs, for example when a plurality of sheets adhere together.

Figure 2:
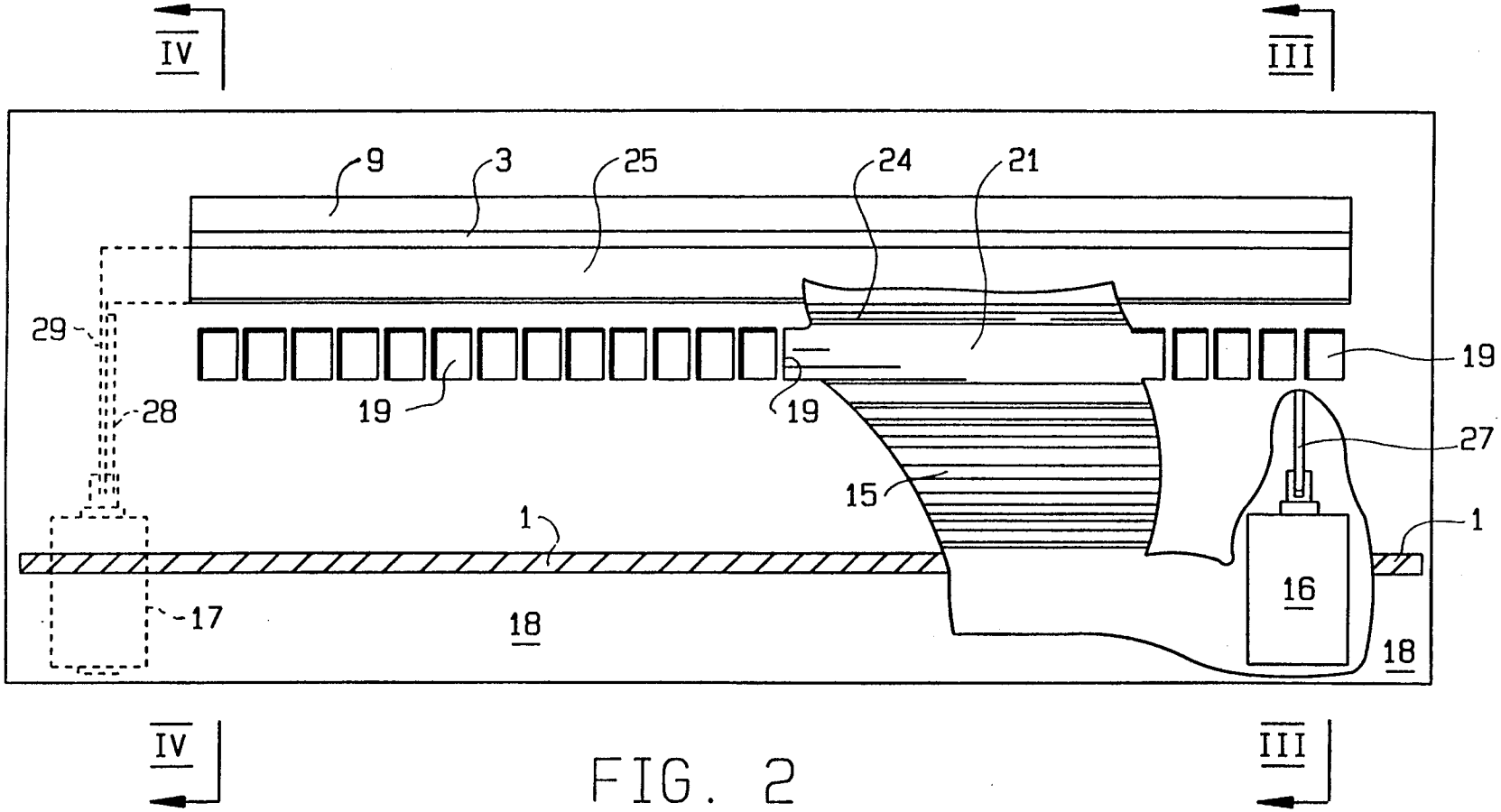
FIG. 2 is a cutaway view along the line II—II of FIG. 1.
Figure 3:
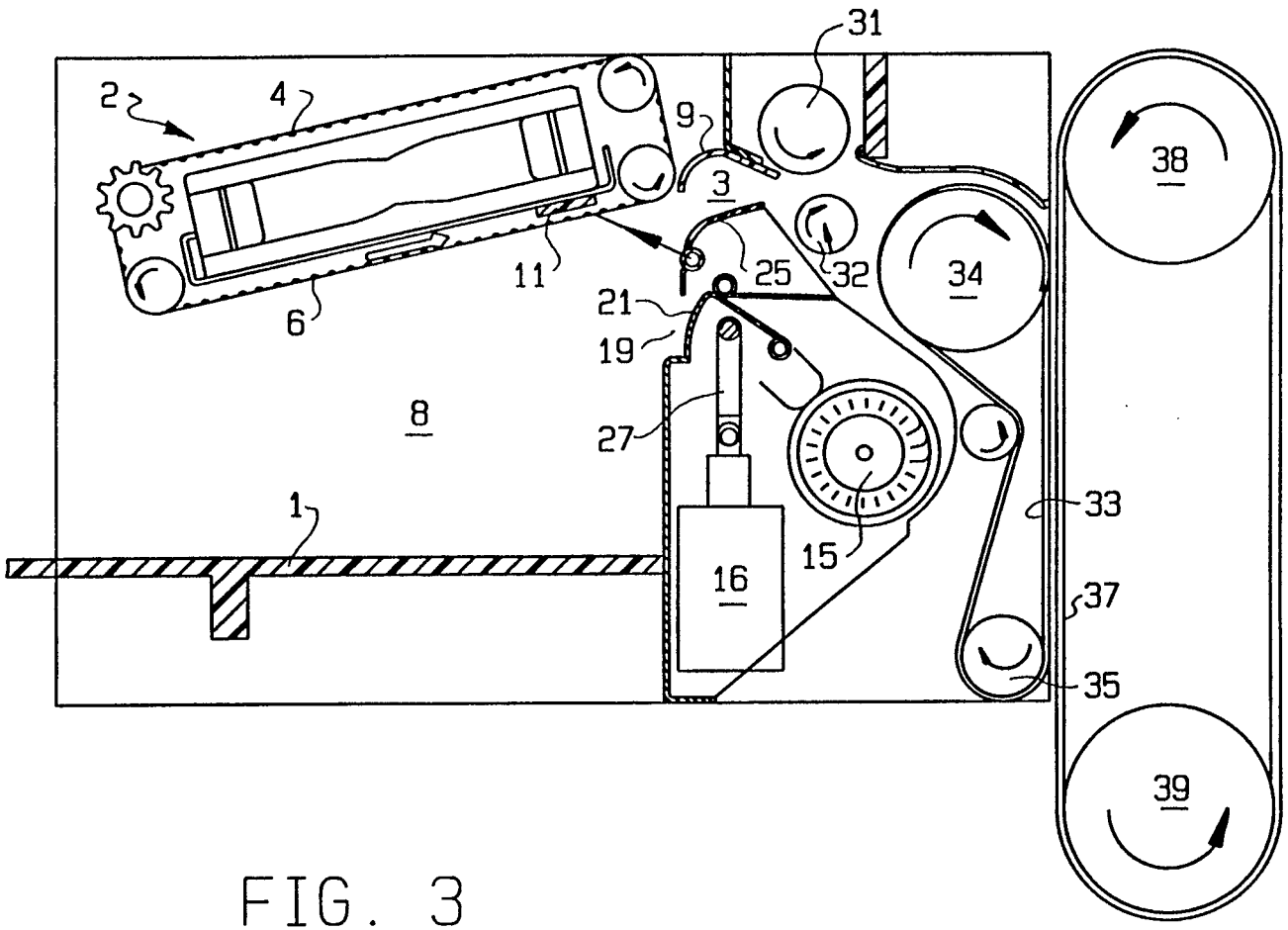
FIG. 3 is a view along the line III—III of FIG. 2.

An exemplary embodiment of the peel-off device according to the invention is illustrated in the accompanying drawings. The peel-off device is designated as a whole by 10. It comprises an air-flow generator consisting, for example, of a turbine 15 extending along the bottom wall 18 of the feed table 1 under the ejection area 3, and this turbine 15 is associated with deflector means arranged so as to direct at least one turbulent air flow virtually onto the leading edge of the upper sheets of the sheet stack 100, as will seen. In the illustrated embodiment, the compartment bottom wall 18 has a plurality of orifices 19; these can be seen clearly in FIG. 2. These orifices 19 are normally closed off by a shutter formed by a flap 21 mounted so as to be pivotable about an axle 22 fastened at its ends to the stand of the machine. The tilting of the flap 21 takes place by means of a link 27 mounted on one end of the flap 21 and driven by an electromagnet 16, as shown in the view of FIG. 3.

Figure 4:
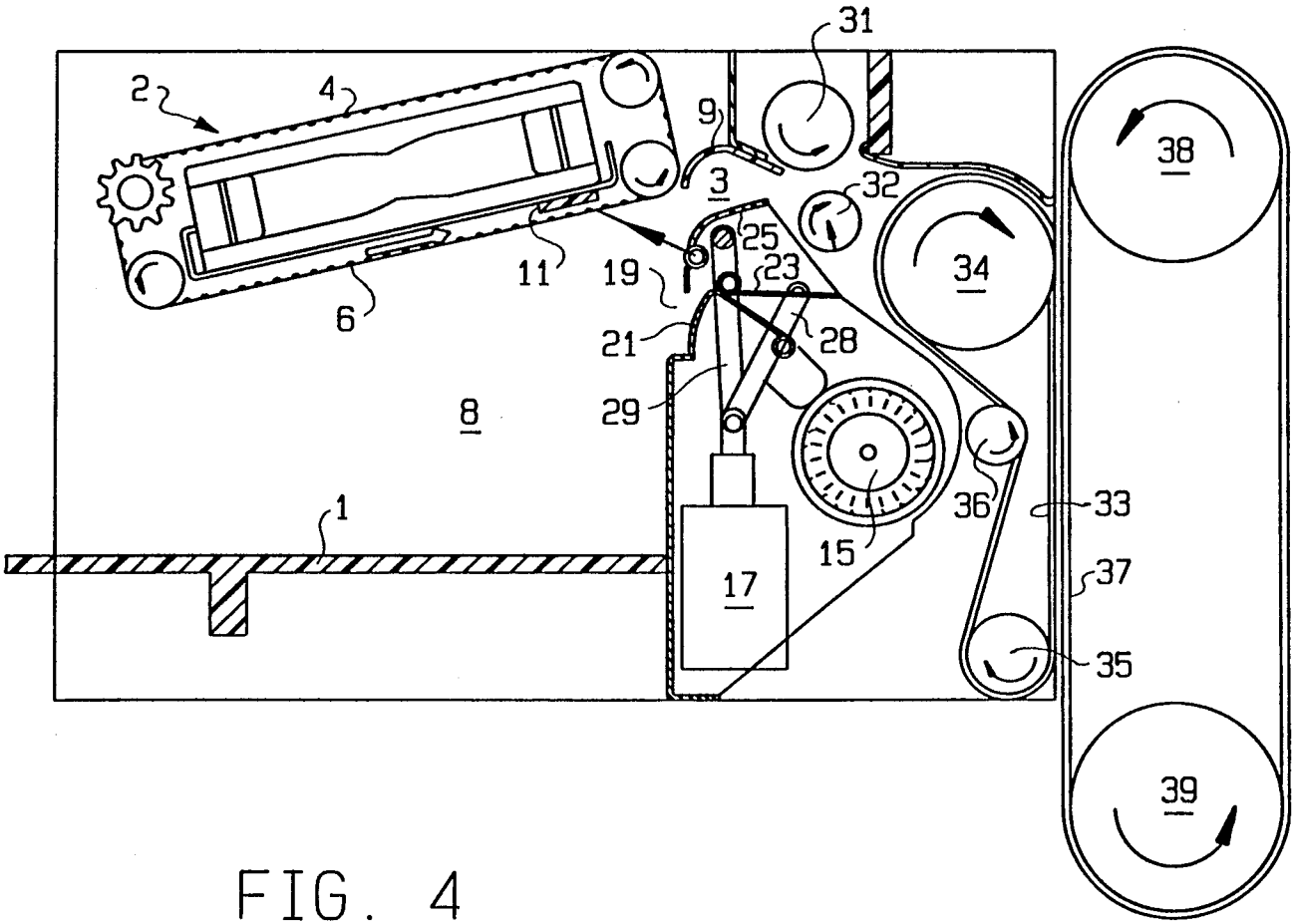
FIG. 4 is a view along the line IV—IV of FIG. 2.

In the embodiment illustrated, two upper flaps 23 and 25, the function of which will be described later, can also be seen. These upper flaps are mounted so as to be pivotable about axles 24 and 26 fastened to the stand of the machine. The flaps 23 and 25 are actuated by links 28 and 29 mounted on one end of the flaps and driven by an electromagnet 17, as shown in the view of FIG. 4.

The peel-off device 10 is controlled by a control processor which can be the general control processor of the machine. For controlling the peel-off device, the processor interacts with a detection device arranged for permanently monitoring the presence of the sheets in the free space 8 in the vicinity of the grid portion 6 and for detecting any operating anomaly on the grid: absence of a sheet, presence of a plurality of sheets adhering to one another, crumpled or folded sheet, sheet of different thickness or printing, etc. More especially, the detection device is a thickness detector mounted and arranged for permanently checking the thickness of material located in front of the grid portion 6 of the sheet take-up device 2. In the exemplary embodiment illustrated, the thickness detector consists of a photoelectric cell 11 responding to a light beam generated by a source 12. The detector cell 11 produces an electrical signal which is a function of the thickness of the material intercepting the light beam always at an identical location.

Figure 5:
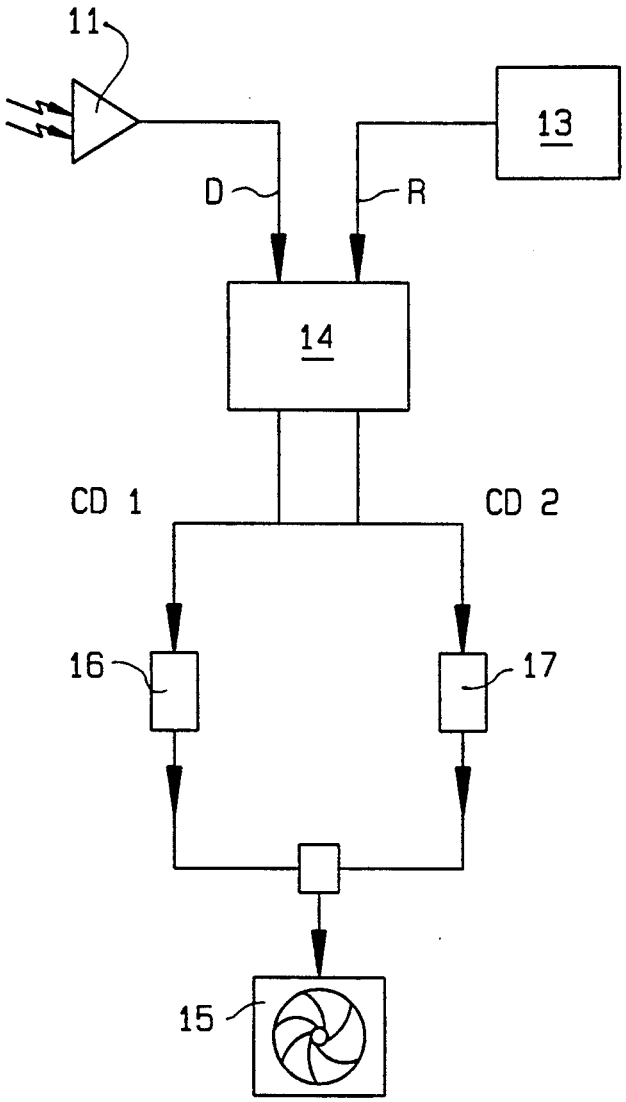
FIG. 5 is a block diagram of the control system of the peel-off device according to the invention.

The control system of the peel-off device according to the invention is represented by the block diagram of FIG. 5. The control unit 14 of the microprocessor receives the detection signal D generated by the detector 11 and compares it with a set point R extracted from a reference memory 13. The set point R represents a value or a range of values of the detection signal corresponding to the presence of a calibrated sheet. The limit values of a predetermined range of reference values will be designated, for example, by R1 and R2. The microprocessor is organized in such a way than the control unit 14 generates a control sisal for either one of the electromagnets 16 and 17 controlling the deflector means, depending on the value of the detection signal D in relation to the reference values R1 and R2.

When a correct sheet is present in the field of detection of the detector cell 11, the detection signal D is between the reference signals R1 and R2 and the microprocessor does not order any correction. The flaps 21, 23 and 25 are then maintained in their closing position, as shown in FIG. 1, and the turbine 15 is at a standstill. The sheet carried along by the grid 6 is then conveyed towards the ejection area 3. The relevant sheet, identified as corresponding to the reference value, then moves as far as a detection cell located downstream of a pressure member consisting of the rollers 31 and 32; the roller 31 is in continuous rotation and the roller 32 is mounted so as to be raised under the control of an electromagnet (not shown) in order to grip the ejected sheet and cause it to advance towards the output members.

Figure 6:
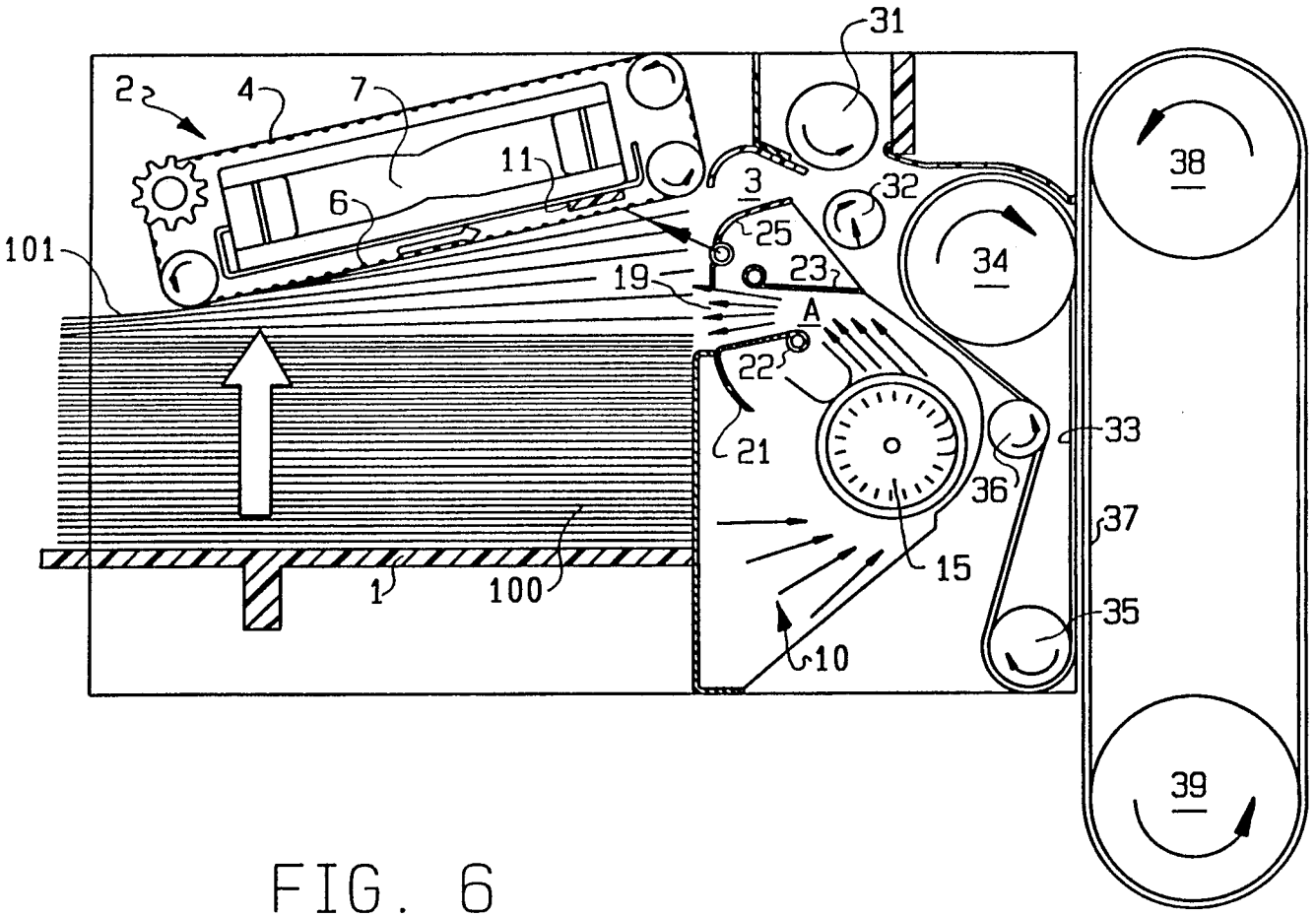
FIGS. 6 and 7 illustrate two operating states of the peel-off device according to the invention.

When there is no sheet present in the field of detection of the cell 11 within a time allowed, the detection cell 11 generates a signal D of a value higher than the reference signal R2, and the microprocessor 14 generates a first control signal CD1 in order to energize the electromagnet 16 driving the lower flap 21, for the purpose of moving the latter downwards and bringing it progressively into its opening position illustrated in FIG. 6, whilst the turbine 15 is put into operation. FIG. 6 does not show the drive mechanism of the flap 21. The air flow generated by the turbine 15 is guided by the channel A towards the orifices 19 and is thus directed onto the leading edge of the sheet stack 100. The sheets are thus lifted in a fan-shaped manner and the upper sheet 101 is sucked up against the grid 6, whilst the other sheets fall back onto the stack 100 due to the air which infiltrates between the upper sheet and the following sheet. The device returns to the state of rest as soon as the detection cell 11 detects the presence of a sheet 101 in its field of detection. Provided that it satisfies the requisite conditions, this sheet is then carried along towards the ejection area 3.

Figure 7:
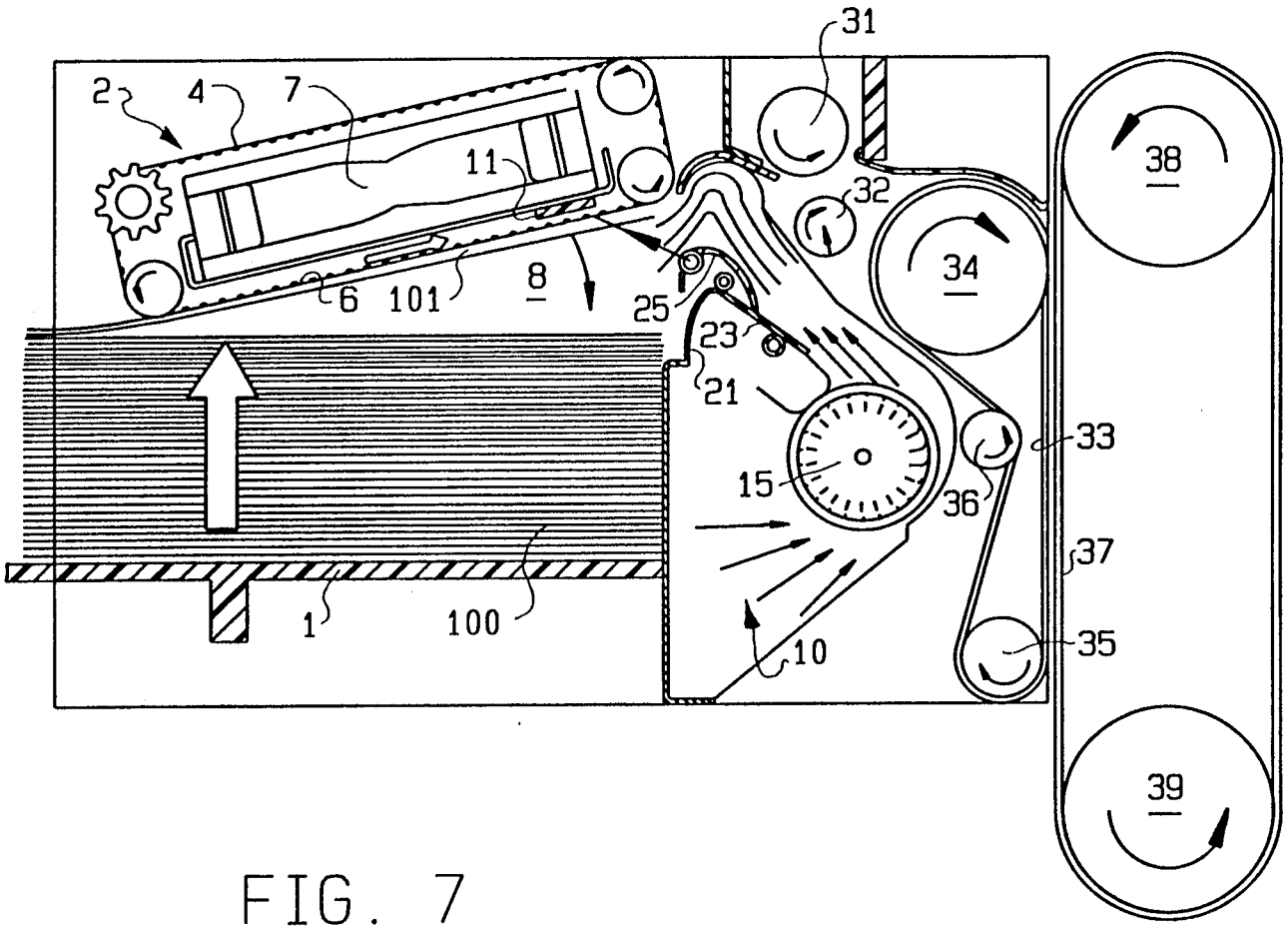

When a plurality of sheets adhere together and are sucked up towards the grid 6 within the time allowed, the detection signal D generated by the cell 11 is lower than the reference signal R1, and the microprocessor 14 generates a second control signal CD2 in order to energize the electromagnet 17 which drives the upper flaps 23 and 25 so as to put them into the positions shown in FIG. 7. To avoid overloading this figure, the drive mechanism of the flaps 23 and 25 is not shown here. The air flow generated by the turbine 15 is then directed via the channel B towards the ejection area 3 and it is thereby directed towards the leading edge of the sheets located within the field of detection of the cell 11. The sheets are set in vibration and the air flow B infiltrates between the sheets in such a way that the upper sheet 101 is sucked up against the grid 6, whilst the other sheets are laid back onto the sheet stack 100. The device returns to the state of rest as soon as the detection cell 11 detects the presence of the single sheet 101 in its field of detection, and provided that it satisfies the requisite conditions this sheet is then carried along towards the ejection area 3.

As a result of the complementary action of the turbulent air flows, the peel-off device according to the invention ensures that sheets are extracted one by one. Any anomaly in the extraction of sheets is identified within the system, without the sheet being displaced from its initial stack. A sheet is delivered to the ejection area 3 only when it satisfies the requisite conditions, thereby considerably reducing waste and interventions by the operator. Moreover, the system automatically adjusts its rate as a function of the quality of the sheets to be processed. It makes it possible to achieve high rates at the compartment exit under good conditions. Finally, it makes it possible to detect a sheet which is not of the same printing, a sheet of different thickness and a crumpled or folded sheet. Where paper sheets are concerned, the range of papers which can be processed is very wide, for example from 10 grams to 300 grams, and in some cases even more.

The peel-off device according to the invention can be combined with any sheen take-up device, for example a current suction-type sheet take-up device. However, the combination of the peel-off device according to the invention with a suction-type sheet take-up device, as described in the foregoing, and illustrated by way of example in the accompanying drawings, is especially advantageous in terms of the optimum result which stems from it as regards efficiency and flow rate. This arrangement according to the invention has made it possible to provide a flow rate of the order of 130 sheets per minute with one feed compartment.

The advantages of the device according to the invention are especially attractive with regard to feeding an assembler comprising a plurality of sheet-feed compartments. The uniform flow of strictly controlled sheets makes it possible to ensure a perfect superposition of the sheets in the assembling system as a result of the synchronization of the controls of the pressure members 31 and 32 of each compartment. As regards a vertical assembler, in which a plurality of feed compartments are superposed, the control pulses actuate the pressure members of each compartment in succession so as to cause the sheets to advance successively towards a conveyor belt 33 circulating on the cylinders 34, 35 and 36. The sheets delivered by a feed compartment are advantageously pressed between the belt 33 and a belt 37 rolling on the cylinders 38 and 39. The belt 37 can extend over the entire height of the assembler. The sheets delivered by any one feed compartment are superposed on the sheets delivered by the upper feed compartments, and the set of superposed sheets, which is pressed between a belt 33 and the belt 37, is conveyed towards the ejection zone of the assembler.

As stated above, the detection elements and other more conventional monitoring members are advantageously controlled by a processor which forms the management unit of the device as a whole. Its programming provides interactive controls in order, for example and in a non-limiting way, to control the starting, stopping and speed of the fan motors, to control and modulate the effects of the peel-off device, to control the translational movement of the grid, and to maintain the relative distance between the lower plane of the grid and the top of the sheet stack as a function of the detection information permanently supplied by the above-mentioned detection elements. This programmed arrangement makes it possible to control the operation of the sheet take-up device continuously and, in particular, to check the nature of each sheet extracted from the top of the stack, so as to detect any anomaly immediately, before transfer towards the ejection area, and to stop the device automatically, to allow the recorded anomaly to be rectified, and then restart the machine. The reliability and efficiency of the automatic control are thereby improved to an optimum degree.

The exemplary embodiment of the invention described in the foregoing is an example given as an illustration and the invention is in no way limited to this example. Any modification, any alternative version and any equivalent arrangement must be considered as coming within the scope of the invention.

I claim:

1. A device for the take-up of pane sheets from a stack of sheets arranged on a feed table (1) including in combination, a sheet take-up device (2) and a peel-off device (10), said peel-off device comprising:

an air-flow generator (15), guide means (A, B) movable between a first position for directing a turbulent air flow produced by said generator (15) onto at least one side of the sheet stack and a second position, a sheet-presence detector having a field of detection and mounted above the feed table (1) for generating a detection signal (D), and a control device (14) being responsive to said detection signal (D) for moving said guide means, wherein the control device (14) compares the value of the detection signal (D) with at least one reference value (R) representing the thickness of a sheet of material to determine whether a sheet is present in said field of detection of the sheet-presence detector (11), and generates in response to said comparison a first control signal (CD1) for moving said guide means (A, B) to position said guide means in said first position to direct the turbulent air flow on the sheet stack when there is no sheet present in the field of detection of the detector (11).

2. The device as claimed in claim 1, wherein the guide mans (A, B) are movable to said second position to direct the air flow along a lower part of the sheet take-up device (2).

3. The device as claimed in claim 2, wherein said control means generates a second control signal wherein said detection signal (D) indicates that the thickness of material that is detected by said sheet-presence detector (11) is greater than said reference value (R), so as to move said guide means to position said guide means in said second position to direct the air flow along the lower part of the sheet take-up device (2).

4. The device as claimed in claim 3, wherein the control device (14) compares the value of the detection signal (D) with at least one reference value (R) corresponding to a predetermined thickness of material, in order to generate the second control signal (CD2) when the thickness of material present in the field of detection of the detector (11) is higher than the thickness corresponding to the reference signal (R).

5. A device for the take-up of plane sheets from a stack of sheets arranged on a feed table (1) including in combination, a sheet take-up device (2) and a peel-off device (10), said peel-off device comprising:

an air-flow generator (15), means defining first and second channels for receiving air from said generator, said first channel configured and dimensioned to direct air onto at least one side of the sheet stack to lift said sheets in a fan-shaped manner with a first, upper sheet forced toward said sheet take-up device, and said second channel configured and dimensioned to direct air onto sheets lifted from the stack to vibrate and separate said sheets such that the first, upper sheet remains lifted and other sheets are forced back to the stack;

movable guide means (A, B) for directing a turbulent air flow produced by said generator (15) via said first channel or said second channel, a sheet-presence detector (11) mounted above the feed table (1) for generating a detection signal (D) representative of the presence or the thickness of sheets on the sheet take-up device, and control device (14) responsive to said detection signal (D) for selectively moving the guide means (A, B) to direct said turbulent air flow via said first or via said second channel.

6. The device as claimed in claim 5, wherein the control device (14) generates a first control signal (CD1) for moving the guide means (A, B) to direct flow via the first channel (A) when the detection signal (D) indicates that no sheet of material is detected by the sheet-presence detector (11).

7. The device as claimed in claim 6, wherein said detection signal (D) is higher than a reference signal (R2) when no sheet is detected by said sheet-presence detector (11).

8. The device as claimed in claim 5, wherein the control device (14) generates a second control signal (CD2) for moving the guide means (A, B) to direct the air flow via the second channel (B) when the detection signal (D) indicates that the thickness of material that is detected by the sheet-presence detector (11) is greater than a reference value (R).

9. The device as claimed in claim 7, wherein said detection signal (D) is less than a second reference signal (R1) when said material thickness detected by said sheet-presence detector (11) is greater than said reference value (R).

10. The device as claimed in claim 5, wherein said guide means (A, B) includes at least one gate member (23).

* * * * *